United States Patent [19]

Allen

[11] Patent Number: 4,507,056

[45] Date of Patent: Mar. 26, 1985

[54] LIQUID CIRCULATION APPARATUS AND METHOD

[75] Inventor: Paul E. Allen, Newtown, Conn.

[73] Assignee: Logic Devices, Inc., Bethel, Conn.

[21] Appl. No.: 538,219

[22] Filed: Oct. 3, 1983

Related U.S. Application Data

[63] Continuation-in-part of Ser. No. 301,358, Sep. 11, 1981, Pat. No. 4,408,960.

[51] Int. Cl.[3] ..... F04F 00/00

[52] U.S. Cl. ..... 417/54; 417/125; 417/136; 417/149; 141/301; 137/588

[58] Field of Search ..... 417/54, 125, 136, 149; 141/301, 303, 199; 137/588

[56] References Cited

U.S. PATENT DOCUMENTS

| | | | |
|---|---|---|---|
| 580,745 | 4/1897 | Wilson | 417/125 |
| 1,371,244 | 3/1921 | Huntley | 141/301 X |
| 3,883,269 | 5/1975 | Wolff | 417/149 X |
| 4,086,765 | 5/1978 | Sillilan | 417/125 X |

*Primary Examiner*—Richard E. Gluck
*Attorney, Agent, or Firm*—Thomas L. Tully

[57] ABSTRACT

Method and apparatus for reducing the resistance to the flow of a liquid from an upper liquid supply container to a lower vacuum receptor tank through an interconnecting port while permitting air displaced from said tank to enter said container through said port. The apparatus includes a valve element which is mounted for opening and closing movement with respect to the port and is biased into normal closed position. The valve element comprises a lower buoyant seating member or ball located in said lower tank and designed to seal said port from below, and an air conduit attached to the seating member or ball for movement therewith. The lower end of the air conduit is open adjacent the ball in the lower tank and the upper end is open to an air space above the liquid level within the upper supply container. Preferably, the valve element also includes a splash member to disrupt the liquid flow from the upper container and facilitate the air flow from the lower tank into and through the air conduit.

24 Claims, 3 Drawing Figures

| | 66 | 67 | 71 | 72 | 75 | 76 |
|---|---|---|---|---|---|---|
| 53 FULL (VACUUM)<br>54 EMPTY (ATMOS. PRESSURE)<br>INTERIM | + | — | — | — | — | + |
| 53 PRESSURIZED<br>+ DISPENSING<br>54 VACUUM<br>+ FILLING | — | + | + | — | — | — |
| 53 EMPTY (ATMOS. PRESSURE)<br>54 FULL (VACUUM)<br>INTERIM | — | + | — | — | + | — |
| 53 VACUUM<br>+ FILLING<br>54 PRESSURIZED<br>+ DISPENSING | + | — | — | + | — | — |

LIQUID CIRCULATION APPARATUS AND METHOD

BACKGROUND OF THE INVENTION

The present application is a continuation-in-part of application Ser. No. 301,358, filed Sept. 11, 1981, now U.S. Pat. No. 4,408,960, issued on Oct. 11, 1983.

Application Ser. No. 301,358 relates to a method and apparatus for the continuous recirculation of a liquid through a work station, such as the circulation of a hot oil through a mold heating conduit, without the need for passing the liquid through a mechanical pump. According to an embodiment of such method and apparatus, liquid is caused to flow from a liquid supply container down into one of a plurality of liquid receptor containers in sequence, when the gas pressure within each receptor container is reduced below the pressure of the gas present in the supply container above the level of the liquid therein. Each receptor container is open to the supply container by a port which is sealed by the seating of a buoyant ball valve when the liquid level in the receptor container raises to filled condition. Thereafter the filled receptor container is pressurized in order to cause the flow of the liquid therefrom, through a circulation conduit including a work station and back to the liquid supply container into which it is sucked due to the lower pressure existing therein compared to the pressure in the pressurized receptor container. The latter pressure also holds the ball valve in seated position to prevent more liquid from entering the circulating receptor container until the gas pressure therein is reduced. The supply container alternates the filling of a different receptor container, open thereto by its own port and ball valve, while the previously-filled receptor container is circulating liquid to the work station.

While such method and apparatus functions well and avoids the need to use mechanical pumps, the seals of which can be damaged by the temperature of corrosive nature of the circulation liquid, I have found that the operation of the apparatus is noisy and causes aeration and foaming of the circulation liquid, and that the rate of flow of the liquid therethrough is not as rapid as expected.

SUMMARY OF THE INVENTION

The present invention is based upon the discovery that the flow of liquid from the supply container through the ports into the different receptor containers is impeded by the back-flow of the gas, such a air, which is displaced from the receptor container back into the supply container. Even though the diameter of the port is quite large, the downward surge of the liquid tends to block the escape of the gas and, conversely, the escape of the gas tends to block the downward flow of the liquid. This results in a loud gurgling noise as the air and liquid oppose each other and the liquid becommes aerated and foamed, causing a slower filling of the receptor containers than is desirable.

While this problem does not exist in situations where the container being filled is vented to the atmosphere or to the supply container, such venting is not possible in situations where the receptor container is one which must be capable of pressurization and depressurization above and below atmospheric pressure independently of the pressure within the supply container.

According to the present invention, the buoyant valve element which opens and closes the port between the supply and receptor containers simultaneously controls the flow of gas from the receptor container to a gas conduit which opens into the gas space above the liquid level in the supply container so that when the buoyant valve is moved to open position to admit liquid from the supply container, gas is permitted to enter a gas conduit which extends up through the liquid in the supply container and to escape freely into the gas space above the liquid level. This permits the mutual displacement of the gas and the liquid freely and quitely and through the use of a single ball valve element.

THE DRAWING

DETAILED DESCRIPTION

Figure 1:
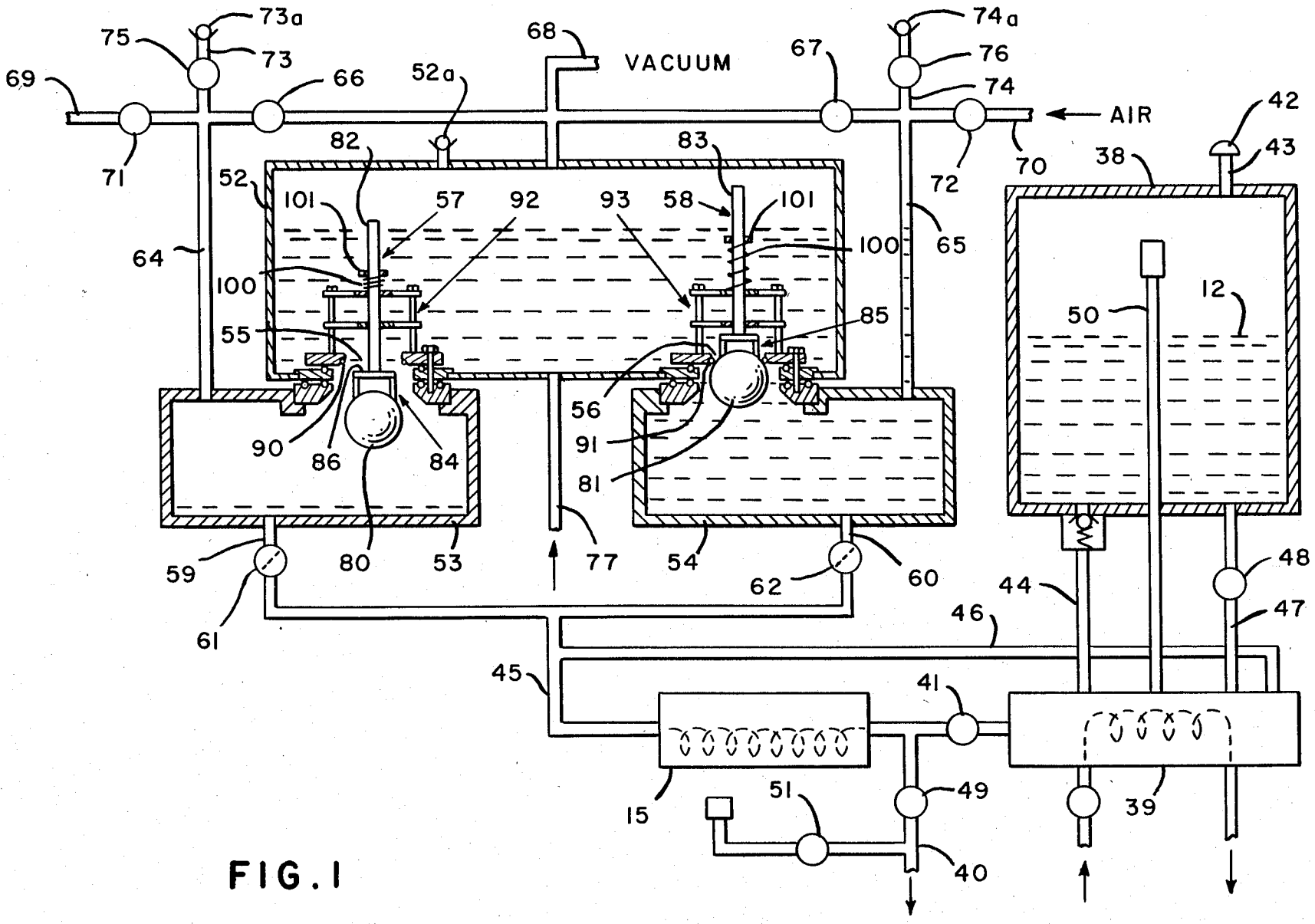
FIG. 1 is a diagrammatic illustration of a system according to an embodiment of the present invention.

Referring to the drawings, FIG. 1 illustrates a preferred apparatus according to the present invention which includes a supply container 52 and two receptor containers 53 and 54, container 54 being illustrated in substantially filled condition and pressurized and in the process of supplying liquid 12, such as hot oil, through a discharge conduit 60 including a check valve 62 and through a heater 15 to a mold, not shown. After passing through the mold heating conduit to heat the mold, as desired, the liquid returns to the system through a return line 77 and is selectively drawn into the supply container 52, container 53 being illustrated in substantially empty condition and under reduced pressure and in the process of receiving liquid 12 from the supply container 52.

When substantially all of the liquid 12 passes from container 54, through the heater 15 and the mold and returns to the container 52, the pressure condition within the containers 53 and 52 is reversed, i.e., filled container 53 is pressurized and empty container 54 is subjected to a vacuum, whereby the liquid 12 is discharged from pressurized container 53 through discharge conduit 59 including a check valve 61 and through the heater 15 to the mold. The liquid returns from the mold through return line 77 and is drawn into the supply container 52 and into the vacuum receptor container 54.

It is clear from the foregoing that the liquid 12 is circulated continuously from one container, through a work station and back to another container without ever passing through any mechanical flow-inducing element or pump. This is of great advantage in cases where the liquid is at such high or low temperature, or is so corrosive or otherwise represents a threat to the operation of a pump or its leak-resistance that it is necessary or desirable to avoid the need to pass the liquid through a pump in order to obtain continuous circulation.

As illustrated by FIG. 1, the pressure and vacuum conduitions created alternately in the containers 53 and 54 are controlled by solenoid valves 71 and 72 which connect a pressurized air supply conduit 70 to each of the containers 53 and 54, and solenoid valves 66 and 67 which connect a vacuum conduit 68 to each of the containers 53 and 54. The conduits 64 and 65 connecting containers 53 and 54 to the vacuum and pressure lines may contain water-cooled condensers, the condensers being advantageous in systems employing hot circulation liquids which may tend to vaporize and be drawn into the vacuum conduit 68. Such vapors are condensed and returned to the respective containers by gravity flow. This also protects the solenoid valves 66, 67, 71 and 72 against exposure to high heat.

The apparatus of FIG. 1 also includes a liquid reservoir tank 38 which permits the system to be drained, if necessary, such as for repair work on containers 52, 53 or 54, and which automatically provides the system with the necessary volume of circulation liquid. Associated with the reservoir tank 38 is a coolant tank 39 which is connected to the inlet mold circulation conduit 40 by means of a solenoid valve 41 which is thermostatically controlled in order to open only when the temperature of the circulation liquid is excessive and is to be reduced by passage of the circulation liquid through the coolant tank 39.

As shown by FIG. 1, the liquid reservoir tank 38 is provided with a vent 42 to the atmosphere and with a fill port 43 which can be connected to a drum of supply liquid. Tank 38 is connected to the coolant tank 39 by means of a fill conduit 44 having a ball float valve to prevent liquid from flowing by gravity to fill the coolant tank 39 and the entire circulation system including the receptor container 53 or 54 which is under reduced pressure.

As shown, the coolant tank 39 is connected to the heater conduit 45 by means of a heater bypass conduit 46 which permits the circulation liquid to flow in a counterclockwise direction during the intial filling operation and in a clockwise direction when the system is being drained or during each cooling sequence when the system is in operation, as will be discussed hereafter.

Reservoir tank 38 is also connected to the coolant tank 39 by means of a drain conduit 47 provided with a mechanical valve 48. The entire system can be drained back into the reservoir tank 38 by opening valve 48 and closing mechanical valve 49 on the inlet mold circulation conduit 40 to cause the air pressure within the filled container, 53, or 54, to force the liquid back through the heater bypass conduit 46, into coolant tank 39 and up the drain conduit 47 into the reservoir tank 38.

The coolant tank 39 contains coolant coils through which cold water or other liquid coolant is circulated to cool the hot circulation liquid present in the tank 39. Cooled circulation liquid does not flow from the tank 39 into the inlet mold conduit 40 until the valve 41 is actuated to open position by means of a heat sensor. Since the heater 15 represents an obstruction to the flow of the circulation liquid, due to the presence of a myriad of electrical heating pipes or coils within the heater, most of the circulation liquid will follow the path of least resistance when the solenoid valve 41 is opened. Thus, most of the circulation liquid being dispensed from container 53 or 54 will bypass the heater 15 and will flow clockwise through the bypass conduit 46, through the coolant tank 39 and through the open solenoid valve 41 into the inlet mold conduit 40. As soon as the circulation liquid has been cooled to the desired temperature, as determined by a heat sensor located somewhere in the sytem, such as in the supply container 52, the solenoid valve 41 will be actuated to closed position to stop the flow of liquid out of the coolant tank and thereby stop the flow of circulation liquid into the bypass conduit 46. Also, it is noted that the solenoid valve is only open to the passage of cooled circulation liquid.

Also connecting the reservoir tank 38 and the coolant tank 39 is an air vent conduit 50 which permits the release of any air contained within the circulation liquid to escape into the vented reservoir tank 38 above the level of the circulation liquid contained therein. Air entrapment and release is most important in cases where the receptor container 53 or 54 which is receiving the circulation liquid back from the mold is under a negative pressure or vacuum so that the circulation liquid passing through the mold is also under a negative pressure. This is a preferred embodiment since it prevents leakage of the circulation liquid into the mold cavity through any cracks which may be present in the walls of the mold. In such cases some air will be drawn into the circulation liquid from the mold cavity through said cracks. Some such trapped air will be released from the liquid as it seeks the most elevated point of the circulation liquid, i.e., the exit of the air vent conduit 50.

Most of such trapped air will escape from the supply container 52 into the vacuum conduit, during evacuation. Also, the air separates easily from the circulation liquid because it is not emulsified therein, as happens during passage through a mechanical pump.

Finally, with respect to FIG. 1, the mold conduit may be drained when neccessary by closing valve 49 to inlet conduit 40 and opening air inlet valve 51 to displace the circulation liquid which will be drawn through the return conduit into container 53 or 54.

Figures 2, 3:
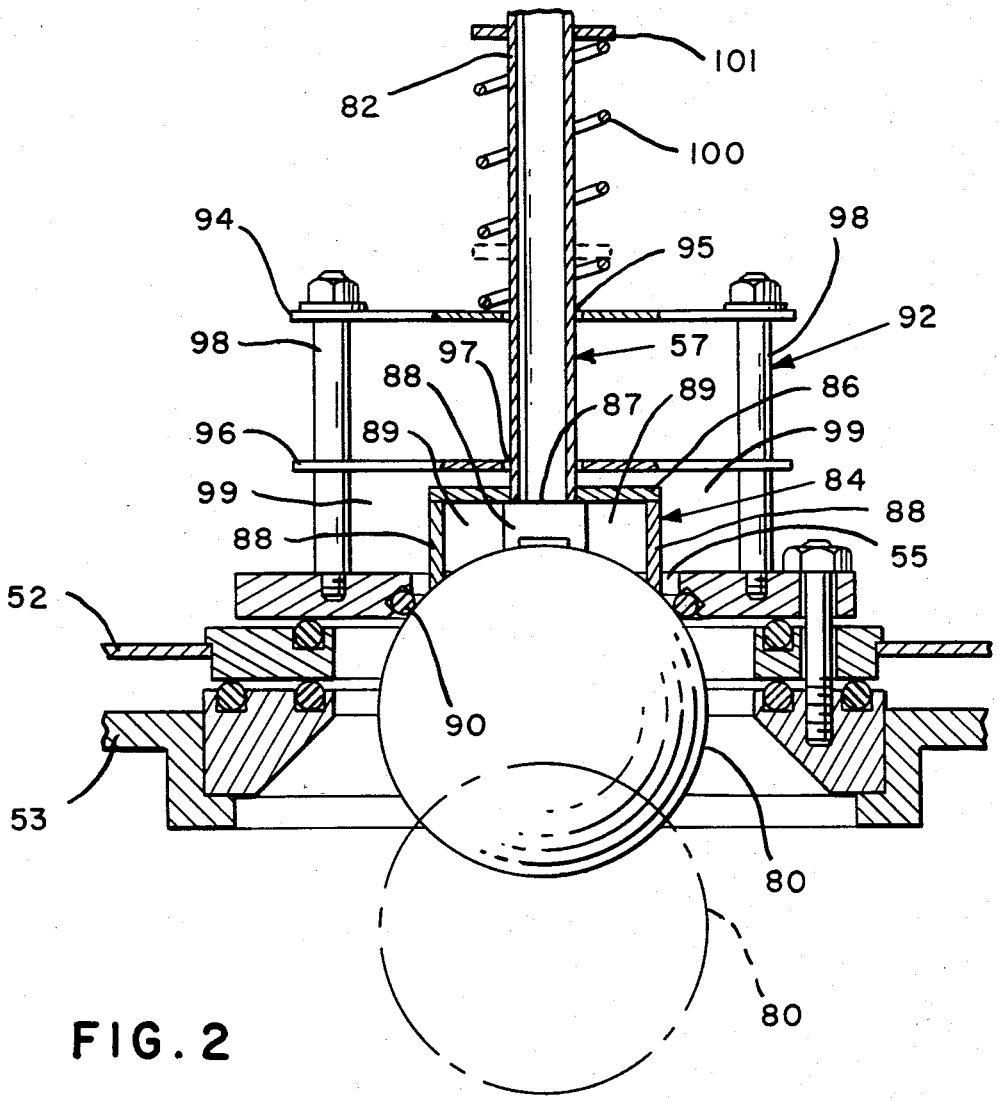
FIG. 2 is detail view of the ball valve assembly present in the system of FIG. 1.
FIG. 3 is a chart illustrating the various concurrent conditions of the air-flow valves controlling the pressure conditions within the receptor containers in the system of FIG. 1 during the complete cycle of operation of the apparatus of FIG. 1.

The embodiment of FIGS. 1 and 2 involves a system which is preferred from the standpoint of simplicity. The apparatus of FIG. 1 comprises a liquid supply reservoir 52 connected to two liquid receptor containers 53 and 54 by means of wide inlet ports 55 and 56, each containing a buoyant flow control ball valve element 57 and 58, respectively, each comprising a lightweight lower metallic sphere 80, 81 connected to an upper air tube 82, 83 by means of a legged splash guard 84, 85. As shown by FIG. 2, which illustrates valve element 57, the legged splash guard 84 comprises an upper metal splash disc 86 having a central opening 87 around the upper periphery of which the air tube 82 is welded, and a plurality of spaced narrow legs 88 which attach the disc 86 to the buoyant sphere 80 while providing a plurality of open air passages 89 therebetween. Thus, air passing upwardly over the surface of sphere 80 can enter the air passages 89 and enter the air tube 82 at opening 87 for movement up the air tube 82.

The valve elements 57, 58 are each supported for opening and closing movement, relative to their respective ports 55, 56 by means of identical open support frames 92, 93 which are more clearly illustrated in FIG. 2. Each support frame 92, 93 comprises a top guideplate 94 having a central opening 95, a fixed splash plate 96, having a central opening 97, a plurality of spaced legs 98 which connect the plates 94 and 96 to each other and to the floor of a supply containers 53, 54, centered relative to its port 55, 56 and provide a plurality of liquid passages 99 under each splash plate 96. Each support frame also comprises spring 100 and retainer 101, the latter being attached to each of the air tubes 82, 83 and confining the spring 100 between itself and the upper surface of the top guideplate 94 with an air tube, 82 or 83, extending through the central openings 95 and 97, thereby biasing the valve elements 57, 58 into normally-closed position in which the metallic spheres 80, 81 are in liquid-tight sealing engagment with the ring gaskets 90, 91 on the undersides of the ports 55, 56, as shown by FIG. 2. The valve element 57 is also shown in open position by means of broken lines in FIG. 2. Containers 53 and 54 also have outlet conduits 59 and 60, each provided with conventional flow control valves 61 and 62, respectively. The outlet conduits 59 and 60 open into the common mold inlet conduit 45, which conduit 45 includes a connection to the heater 15, chiller 39, reservoir tank 39 and bypass conduit 46 as discussed hereinbefore.

The air space of the supply container 52 of FIG. 1 is vented by means of a check valve **52*a* to maintain it at no more than atmospheric pressure, and is also connected to the containers 53 and 54 by means of air conduits 64 and 65 containing solenoid valves 66 and 67, respectively, so that either container 53 and 54 can be opened to the air pressure within the supply container 52 which is maintained under a vacuum pressure by connection to a main vacuum conduit 68. Air conduits 64 and 65 are also connected to air pressure conduits 69 and 70, each provided with a solenoid valve 71 and 72, respectively, and to pressure vent conduits 73 and 74, each provided with solenoid valves 75 and 76, respectively, and with check valves 73*a* and 74*a* which close when the pressure within conduits 73 and 74** is atmospheric or lower.

As can be seen from FIG. 1, either container 53 or 54 can be subjected to pressurized condition by opening solenoid 71 or 72 while closing solenoids 66 and 75 or solenoids 67 and 76. Similarly, either container 53 or 54 can be subjected to vacuum conditions by opening solenoid 66 or 67 while closing solenoids 71 and 75 or solenoids 72 and 76. Also, the pressure within either container 53 or 54 can be released to the atmosphere, rather than into the vacuum conduit by opening solenoid valve 75 or 76 while closing solenoid valves 66 and 71 or 67 and 72.

As shown by FIG. 1, the return conduit 77 from the mold opens into the supply reservoir 52 so that the circulation liquid is drawn from the mold back into the supply reservoir 52 by the vacuum pressure existing within reservoir 52.

The apparatus of FIG. 1 is illustrated with container 54 in filled condition and container 53 in empty condition. In the filled condition the liquid level extends up the air conduit, 64 for container 53 and 65 for container 54, so as to be equal with the liquid level in the supply container 52. In the empty condition some liquid remains in the container 54, or 53, above the flow control valve 62, or 61, to prevent air from entering the mold inlet conduit 45.

As illustrated, container 54 is under the vacuum pressure existing within the supply container 52, whereby the liquid is caused to flow through the valve element 58 into container 54. Such vacuum pressure is exerted within container 54 by opening solenoid valve 67 while closing solenoid valves 72 and 76. While container 53 was under pressurized condition caused by opening solenoid valve 71 while closing solenoid valves 66 and 75, thereby exposing container 53 and its contents to the desired air pressure, the pressurized circulation liquid flowed from container 53 through flow control valve 61 into the mold inlet conduit 45, through the mold heating conduit and back through the mold return conduit 77 into the supply container 52.

The total quantity of liquid circulated from each container 53 and 54 preferably is regulated by timer means which activate the various solenoid valves to alternate the pressure and vacuum conditions within the supply containers 53 and 54. Thus, when the timer senses the desired quantity of liquid flow from container 54, it activates valve 72 to closed position and valve 76 to open position to release the air pressure from container 54. After a pause of one or two seconds, valves 66 and 76 are activated to closed position and valves 67 and 71 are activated to open position to subject the filled container 53 to pressure conditions and subject the empty container 54 to vacuum conditions. This causes container 53 to dispense the circulation liquid into the mold inlet conduit 63 and causes container 54 to refill with circulation liquid as the reduced pressure in container 54 permits the liquid to dump or flow rapidly by gravity through the wide flow control valve 58 from the supply container 52. This flow pattern continues for the predetermined time period, as determined by an adjustable timer, after which the procedure is reversed by the activation of the solenoid valves 71 and 75, to release the air pressure within container 53 and valves 75, 66, 67 and 72 to convert container 53 to vacuum conditions and container 54 from vacuum to pressure conditions to reverse the flow pattern with respect to the containers 53 and 54.

The present, novel flow control valve elements 57 and 58 comprise a lightweight, hollow, smooth metal sphere 80, 81 which sealingly engages a gasket or O-ring 90, 91 at the opening of the wide ports 55, 56 into the containers 53 and 54, respectively, when each container reaches filled condition. The spheres 80, 81 preferably are of sufficient weight to float on the liquid so that about one half of the ball is above the liquid level, thereby assuring that each container will be substantially completely filled with liquid to the exclusion of any air. After each filling operation, when the filled container is changed from vacuum to pressure conditions, the flow control valve elements, 57 or 58, will remain closed since the sphere thereof will be held up, against gravity, in seated or closed position by the spring 100, and because of the pressure differential between tank 52 and the pressurized filler container, 53 or 54. Closed position will be maintained until such pressure differential is removed, i.e., the pressure within container 53 or 54 is released and a vacuum is pulled therein. At such time, the flow control valve element 57 or 58 opens by the sphere 80 or 81 being sucked down by the vacuum pressure within its receptor container to permit liquid to dump quickly through the wide port 55 or 56 to quickly fill the container, as illustrated by the position of the ball in valve element 57 of FIG. 1 at the instant that container 53 is converted from pressurized to vacuum conditions to cause it to be refilled with liquid from supply container 52. The diameter of ports 55 and 56 is preferably from about two times to about four or more times the diameter of the circulation conduit 45. For example, the former may have a two-inch diameter and the latter a diameter of one-half or three-quarter inch.

The main advantage of the structure of flow control valve elements 57 and 58 is that they offer no resistance to the flow of liquid from tank 52 to containers 53 and 54 when they move into open position and that they function simultaneously as both liquid and gas flow control valves in a single operation. Thus, at the same time that the valve elements 57 or 58 are drawn open to admit the gravity and suction flow the liquid from the supply container 52 to a receptor container 53 or 54, through the liquid passages 99 of the open framework of the valve support structures 92 and 93, beneath the fixed lower plate 96, gas displaced from the receptor container, 53 or 54, is able to pass relatively freely through the liquid in the supply container 52 to the air space at the top thereof. This is made possible by the air tubes 82 and 83 and the splash guards 86, the latter deflecting the downward flow of the liquid away from the air passages 89, adjacent the surface of the spheres 80 and 81, so that the displaced air can enter therein and pass up through the air tubes 82 and 83 without the noise and retardation which normally results from the passage of air through a body of water.

Since the volume of air present in the filled containers 53 or 54 is limited to the small volume of air present in the air conduits 64 or 65 above the liquid level of the supply reservoir, very little energy is lost when the filled container is converted from vacuum to pressure conditions to cause the liquid to begin flowing from the filled container.

Also, since the circulation fluid continuously circulates through the central supply container 52, the temperature of the liquid can be maintained consistent by providing heating and cooling means in or associated with the supply container 52, thereby avoiding any need for the heater 15 and/or the cooling tank 39.

FIG. 3 illustrates the sequence of operation of the solenoid valves for the receptor containers 53 and 54 for the filled or empty interim periods and for the periods during which each container is under pressurized dispensing condition, plus signs indicating the open condition of valves and minus signs indicating closed condition. When each container reaches empty condition, it is closed to the air pressure conduit, 69 or 70, and open to the vent conduit 73 or 74, to release the air pressure and stop the further flow of liquid from said container. Thus, for a brief interim period of one or more seconds, the empty container is opened to atmospheric pressure to stop the liquid circulation and then is opened to the vacuum at the same time that the full container is opened to the pressure conduit. This causes the circulation liquid to begin flowing immediately from the full container to the mold conduit and causes the empty container to begin filling with more circulation liquid received from the supply container 52 as soon as the vacuum pressure within the empty container and the weight of the liquid within the supply reservoir are sufficient to overcome the vacuum pressure within the supply container 52, i.e., within a few seconds.

FIG. 3 is self-explanatory in illustrating the alternating open and closed conditions of the various solenoid valves during the cylces of operation of the apparatus of FIG. 1. As discussed hereinbefore, the solenoid valves may be activated to the open and closed positions by timer means, the adjustment of which will depend upon the capacity of the receptor containers 53 and 54 and the flow rate of the circulation liquid through the mold conduit. For example, if the containers have a capacity of five gallons each and the flow rate is twenty gallons per minute, the flow from each tank must be stopped after a period of less than fifteen seconds, so that at least some small residual amount of liquid remains in the empty tank and no air enters the circulation conduit. In such cases the timer may be set to release the pressure in the dispensing container after 10, 12 or 14 seconds, for example, since the volume of liquid circulated from the containers is not critical. However, the greater the volume, the less frequent is the activation of the various solenoid values, i.e., the change-over of each container from pressurized to vacuum conditions.

It will be clear to one skilled in the art that either the high level detecting switches and/or the low level detecting switches may be used in receptor containers 53 and 54, or timer means may be used since the volume and flow rate of liquid being circulated from one container to the next is determinable and relatively constant. When the supplying container is at the desired low level, the receiving container is at the desired high level, and vice-versa. Thus, the detection of either level is a detection of the other since the containers have the same capacity, and the activation of either switch may be used to reverse the state of the gas inlets and gas outlets of both containers, causing pressurization of the "empty" supplying container. As disclosed above, a slight time delay preferably is incorporated to delay the depressurization of the "empty" supplying container until after the receiving container begins supplying the liquid to the work station.

It should be understood that the present liquid conduit system is continuously full of the circulation liquid, to the exclusion of any gas or air. It is only the path or flow pattern of the liquid which changes due to the suction pressure within the return conduit 77 being influenced by only the supply container 52 which is always under a lower pressure than the one of the receptor containers 53 or 54 which is in the dispensing mode.

While the present invention is primarily concerned with a mold heating system provided with heating means to reheat the circulated liquid to the desired temperature, i.e., as high as 450° F. or more, after the liquid has passed through the heat-transfer passages of the mold and has transferred some of its heat to the mold, it should be understood that the present invention applies equally well to any system in which liquid is to be treated after circulation in order to restore its functional property prior to recirculation. Thus, the liquid containers or the circulation conduit may be provided with cooling means to reduce the temperature of the liquid to a desired level, such as in the case of a mold-cooling operation, or with purifying means, filter means, concentration-regulating means or any other means for restoring the temperature, purity, concentration or other functional properties of the circulation liquid to a required recirculation condition without the liquid having to pass through flow-inducing elements such as mechanical pumps which might be damaged by the temperature or corrosive nature of the liquid.

The present work station need not be a mold heating or cooling station. It may be any work station in which the liquid accomplishes a desired function and, in the process, has a desired property thereof reduced, thereby requiring that such property be restored before the liquid is recirculated.

The gas conduits 69 and 70 of FIG. 1 may conveniently be connected to a common pressurized gas source, such as an air tank maintained at a suitable elevated pressure. In the case of hot oil as a circulation liquid, it has been found that a pressure of about 40 psi is sufficient. However, other liquids may require higher pressures. Also, the rate of circulation may be increased, where desirable, by providing a greater differential between the elevated pressure in the supply container and the reduced pressure in the receptor container.

In place of level detection switches or a timer means, a single external weight detection switch may be used for each receptor container to activate the solenoid valves for the gas inlets and outlets when the weight of the liquid in any container reaches maximum and minimum limits.

While FIG. 1 illustrates a system in which two or more spaced receptor containers are employed, it should be understood that such containers may, in fact, be attached to one another in side-by-side relation so as to be, in effect, isolated compartments of a single container.

Valves 75 and 76 of FIG. 1 function to release the air evacuated from each receptor container when it is changed over from pressurized to depressurized condition into the atmosphere. This is advantageous in cases where the outlets are connected to a vacuum tank or pump since it isolates the discharged air from the vacuum source to prevent depletion of the vacuum and unnecessary overworking of the vacuum pump.

It is also possible to use gasses other than air to create the elevated pressures used according to the present invention. Since some circulation liquids, such as oils, may be reactive with air and/or may oxidize in the presence of the oxygen present in the air, it may be desirable to use a closed gas circulation system in which the gas is nitrogen or other gas which is inert with respect to the particular liquid used.

If desired, the means used to heat and/or cool the circulation liquid, such as the electrical heating elements of heater 15 and/or the cooling coils of cooling tank 39 of FIG. 1 may be located within the containers 52, 53 or 54 of FIG. 1, thereby eliminating the need for the heater 15 and/or the cooling tank 39, reducing the number of connections present in the circulation system and reducing the number of potential leakage points.

Variations and modifications within the scope of the present claims will be apparent to those skilled in the art in the light of the present disclosure.

I claim:

1. In an apparatus for dumping circulation liquid from a supply container into a reduced-pressure lower receptor container through a connecting port while displacing air from said receptor container, through said port and into said supply container, the improvement which comprises a valve assambly within said port, said assembly having a bouyant valve closure member located beneath said port in the receptor container and an upper air conduit which extends through said port into the supply container, said air conduit having an open air-intake lower end at or below said port, at least when the valve closure member is in open position, to permit air displaced from said receptor container to pass through said air conduit into said supply container, and having an open air-exhaust upper end near or above the level of the liquid in said supply container, said buoyant valve closure member being designed to float at the liquid level in said receptor container so as to close said port when the receptor container reaches filled condition and to simultaneously block the flow of additional air from the receptor container through the port into said air conduit, and to remain in closed position when the pressure in the receptor container is elevated above the pressure in the supply container, during the discharge of liquid from the receptor container, and to open said port when the receptor container is in empty condition and is subjected to reduced pressure, to cause liquid to flow from the supply container into the receptor container and to permit air displaced from the receptor container to flow from the receptor container into said air conduit through said port and into the supply container.

2. The apparatus according to claim 1 in which said buoyant closure member and said air conduit comprise a unitary valve assembly in which said air conduit is attached, adjacent its lower end to said closure member by attachment means which do not seal the air-intake lower end of said air conduit.

3. The apparatus according to claim 2 in which the attachment means comprises a splash plate which diverts the flow of liquid away from the intake end of the air conduit to facilitate the flow of air into said intake end of the air conduit.

4. The apparatus according to claim 2 which further comprises a support frame in the supply container, extending above the port, said support fraeme including a guide member which supports the air conduit for vertical movement between open and closed positions of the valve assembly.

5. The apparatus according to claim 4 in which said support frame includes means for biasing the valve assembly into normally closed position.

6. The apparatus according to claim 5 in which the biasing means comprises a retainer on the air conduit at a location above the support frame and a spring confined between said retainer and said support frame to urge the valve asesmbly upwardly to a position in which the valve closure member seals the port.

7. The apparatus according to claim 5 in which the biasing means is designed to maintain the valve assembly in closed position until the pressure within the receptor container is reduced to subatmospheric pressure to suck liquid from the supply container through the port into the receptor container.

8. The apparatus according to claim 1 in which said buoyant valve closure member is also pressure-sensitive so that it is retained in closed position while the receptor container is under superatmospheric pressure and is being emptied, and is moved to open position when such superatmospheric pressure is relieved.

9. Apparatus for causing the rapid recirculation of a liquid between a plurality of containers solely by adjusting the pressure of gas exerted within each of said containers between superatmospheric and subatmospheric pressures, comprising a closed liquid circulation apparatus having a supply container, at least one receptor container located beneath said supply container, and an inter-connecting port, a liquid circulation system comprising a circulation conduit which communicates with said supply container and each said receptor container and which incorporates a work station, at least one of said containers and said liquid circulation conduit being designed to be substantially filled with a circulation liquid while at least one container is substantially empty of said liquid, and a buoyant, pressure-sensitive valve assembly having a buoyant valve closure member located beneath each port in each said receptor container and an upper air conduit which extends through said port into said supply container, said air conduit having an open air-intake lower end at or below said port, at least when valve closure member is in open position, and having an open air-exhaust upper end near or above the level of the liquid in said supply container, said valve closure member of said pressure-sensitive assembly being designed to float at the liquid level in said receptor container so as to close said port when the receptor container reaches filled condition and to simultaneously block the flow of additional air from the receptor container into said air conduit, and to be maintained in closed position while the receptor container is under superatmospheric pressure, and to open said port after the receptor container is in empty condition and said superatmospheric pressure is released, to permit air to flow from said receptor container into said air conduit through said port and into said supply container, pressure means associated with each said receptor container for subjecting each said receptor container, when filled with said liquid, to superatmospheric pressure to maintain said valve closure member closed and to force substantially all of said liquid out of said receptor container and into said circulation conduit to said work station, vacuum means associated with each said receptor container for subjecting each said receptor container, when empty of said liquid, to subatmospheric pressure to open said valve closure member and suck liquid out of said supply container to substantially fill said empty receptor container and to cause air displaced from said receptor container to flow through said air conduit and said port into said supply container, and means for activating each said pressure means and vacuum means in sequence so that each said receptor container in sequence is subjected to the maximum superatmospheric pressure to dispense said liquid and then subjected to the maximum vacuum pressure to receive said liquid.

10. The apparatus according to claim 9 in which said buoyant closure member and said air conduit comprise a unitary valve assembly in which said air conduit is attached, adjacent its lower end to said closure member by attachment means which do not seal the air-intake end of said air conduit.

11. The apparatus according to claim 10 in which the attachment means comprises a splash plate which diverts the flow of liquid away from the intake end of the air conduit to facilitate the flow of air into said intake end of said air conduit.

12. The apparatus according to claim 10 which further comprises a support frame in the supply container, extending above the port, said support frame including a guide member which supports the air conduit for vertical movement between open and closed positions of the valve assembly.

13. The apparatus according to claim 12 in which said support frame includes means for biasing the valve assembly into normally closed position.

14. The apparatus according to claim 13 in which the biasing means comprise a retainer on the air conduit at a location above the support frame and a spring confined between said retainer and said support frame to urge the valve assembly upwardly to a position in which the valve closure member seals the port.

15. The apparatus according to claim 13 in which the biasing means is designed to maintain the valve assembly in closed position until the pressure within the receptor container is reduced to subatmospheric pressure to suck liquid from the supply container through the port into the receptor container.

16. The apparatus according to claim 9 in which said buoyant valve clousure member is also pressure-sensitive so that it is retained in closed position while the receptor container is under superatmospheric pressure and is being emptied, and is moved to open position when such superatmospheric pressure is relieved.

17. Method for dumping circulation liquid from a filled supply container into an empty lower receptor container through a connecting port while displacing air from said receptor container, through said port and into said supply container, comprising said supply container, said lower receptor container and said interconnecting port, means for alternating the air pressure within said receptor container, providing within said port a valve assembly having a pressure-sensitive buoyant valve closure member located beneath said port in the receptor container and an upper air conduit which extends through said port into the supply container, said air conduit having an open air-intake lower end at or below said port, at least when the valve closure member is in open position, to permit air displaced from said receptor container to pass through said air conduit into said supply container, and having an open air-exhaust upper end near or above the level of the liquid in said supply container, maintaining the air pressure within said receptor container above the air pressure within said supply container to force said bouyant valve closure member, which is floating at the liquid level in said receptor container, into closed position to seal said port and to simultaneously block the flow of additional air from the receptor container through the port into said air conduit and to force the liquid from said receptor container into a liquid conduit to empty the recepter container, reducing the air pressure within the empty receptor container below the air pressure within said supply container to cause the pressure-sensitive valve closure member to release sealing engagement with said port to cause liquid to flow from the supply container into the receptor container and to permit air displaced from the receptor container to flow from the receptor container into said air conduit through said port and into the supply container.

18. Method according to claim 17 which comprises uniting said buoyant closure member and said air conduit as a unitary valve assembly in which said air conduit is attached, adjacent its lower end to said closure member by attachment means which do not seal the air-intake end of said air conduit.

19. Method according to claim 18 which comprises attaching said closure member and said air conduit by means of a splash plate which diverts the flow of liquid away from the intake end of the air conduit to facilitate the flow of air into the intake end of the air conduit.

20. Method according to claim 18 which further comprises supporting said unitary valve assembly by means of a support frame in the supply container, extending above the port, said support frame guiding the air conduit for vertical movement between open and closed positions of the valve assembly.

21. Method according to claim 17 which comprises biasing the valve assembly into normally closed position.

22. Method according to claim 21 which comprises providing a retainer on the air conduit at a location above the support frame and confining a spring between said retainer and said support frame to urge the valve assembly upwardly to a position in which the valve closure member seals the port.

23. Method according to claim 17 which comprises maintaining the valve assembly in closed position until the pressure within the receptor container is reduced to subatmospheric pressure to suck liquid from the supply container through the port into the receptor container.

24. Method according to claim 17 which comprises making said buoyant valve closure member pressure-sensitive so that it is retained in closed position while the receptor container is under superatmospheric pressure and is being emptied, and is moved to open position when such superatmospheric pressure is relieved.

* * * * *